US009909385B2

(12) United States Patent
Cocker, III et al.

(10) Patent No.: US 9,909,385 B2
(45) Date of Patent: Mar. 6, 2018

(54) ROTATING WELLHEAD HANGER ASSEMBLIES

(71) Applicant: Cameron International Corporation, Houston, TX (US)

(72) Inventors: John J. Cocker, III, Houston, TX (US); Shailesh U. Vaghmashi, Missouri City, TX (US); Jacob C. Emmett, Brenham, TX (US); Randy Gonzalez, Richmond, TX (US); Andrew R. Hanson, Cypress, TX (US); James D. Cavanagh, Cedar Park, TX (US); Michael F. Levert, Jr., Sugar Land, TX (US)

(73) Assignee: Cameron International Corporation, Houston, TX (US)

( * ) Notice: Subject to any disclaimer, the term of this patent is extended or adjusted under 35 U.S.C. 154(b) by 586 days.

(21) Appl. No.: 14/521,253

(22) Filed: Oct. 22, 2014

(65) Prior Publication Data

US 2015/0041151 A1 Feb. 12, 2015

Related U.S. Application Data

(63) Continuation-in-part of application No. 13/867,947, filed on Apr. 22, 2013, now Pat. No. 9,689,229.

(51) Int. Cl.
*E21B 33/14* (2006.01)
*E21B 33/04* (2006.01)

(52) U.S. Cl.
CPC ..... *E21B 33/14* (2013.01); *E21B 33/0415* (2013.01)

(58) Field of Classification Search
CPC ..... E21B 33/0415; E21B 33/14
See application file for complete search history.

(56) References Cited

U.S. PATENT DOCUMENTS

| | | | | |
|---|---|---|---|---|
| 2,788,073 | A | 4/1957 | Brown | |
| 3,901,546 | A | 8/1975 | Piazza et al. | |
| 5,002,131 | A | 3/1991 | Cromar et al. | |
| 6,749,018 | B1 | 6/2004 | Ford et al. | |
| 7,275,591 | B2 | 10/2007 | Allen et al. | |
| 7,377,337 | B2 * | 5/2008 | Swietlik | E21B 4/006 175/101 |
| 8,528,650 | B1 | 9/2013 | Smith et al. | |
| 2004/0149431 | A1 * | 8/2004 | Wylie | C09K 8/12 166/242.1 |
| 2013/0319688 | A1 | 12/2013 | Moellendick | |
| 2014/0311753 | A1 | 10/2014 | Hanson | |

OTHER PUBLICATIONS

Massey et al., U.S. Appl. No. 14/194,299, filed Feb. 28, 2014.
Nguyen et al., U.S. Appl. No. 14/209,469, filed Mar. 13, 2014.

* cited by examiner

*Primary Examiner* — David L Andrews
(74) *Attorney, Agent, or Firm* — Eubanks PLLC

(57) ABSTRACT

Rotating wellhead hanger assemblies are provided. In one embodiment, a wellhead hanger assembly includes a casing hanger and a casing hanger running tool coupled to the casing hanger. An exterior surface of the casing hanger includes a recess and the casing hanger running tool includes a dog that extends inward from the casing hanger running tool into the recess of the exterior surface of the casing hanger. Engagement of the dog with the recess of the casing hanger facilitates synchronous rotation of the casing hanger and its running tool. Additional systems, devices, and methods are also disclosed.

11 Claims, 13 Drawing Sheets

ROTATING WELLHEAD HANGER ASSEMBLIES

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, pumps, fluid conduits, and the like, that control drilling or extraction operations.

As will be appreciated, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to wellhead hangers for rotating tubular strings in wells. In some embodiments, running tools are used to rotate casing hangers and attached casing strings during running or cementing of the casing strings in the wells. Locking dogs installed in the running tools engage the casing hangers. These dogs transmit torque from a running tool to a casing hanger so that the casing hanger rotates synchronously with the running tool when the running tool is rotated in one direction, but also allow the running tool to be rotated in an opposite direction to unthread the running tool from the casing hanger.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
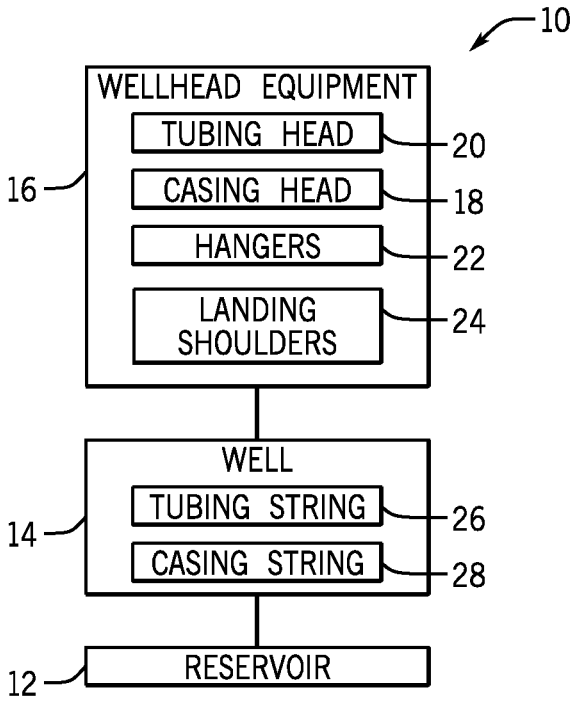
FIG. 1 generally depicts various components, including casing and tubing strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as hangers 22. But the components of the wellhead equipment 16 can differ between applications, and could include a variety of casing heads, tubing heads, hangers, sealing assemblies, stuffing boxes, pumping tees, and pressure gauges, to name only a few possibilities.

The hangers 22 can be positioned on landing shoulders 24 within the tubing and casing heads. These landing shoulders 24 can be integral parts of the tubing and casing heads or can be provided by other components, such as packoffs, other sealing assemblies, or landing rings disposed in the tubing and casing heads. Each of the hangers 22 can be connected to a tubing string 26 or a casing string 28 to suspend such strings within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Rotating the casing string during cementing can increase uniformity of the cement about the casing string and reduce the size or frequency of undesirable cavities or fissures in the cement. Further, rotating the casing string can also facilitate running of the casing string into the well through the wellhead, such as when running the casing string into highly deviated wells. The casing strings can be rotated via casing hangers attached to the casing strings. In various embodiments described below, the casing hangers attached to casing strings can be rotated on a landing shoulder or lifted off of a landing shoulder during rotation. Indeed, to facilitate rotation, in some embodiments an upward force can be applied to the casing hanger to reduce the amount of loading by the casing hanger on a landing shoulder without lifting the casing hanger off of the shoulder. Any suitable devices or machines may be used to rotate the casing hangers (and their attached casing strings) and to run the casing strings into wells. For example, a top drive can be used to run a casing string into a well and to rotate the casing string.

Figure 2:
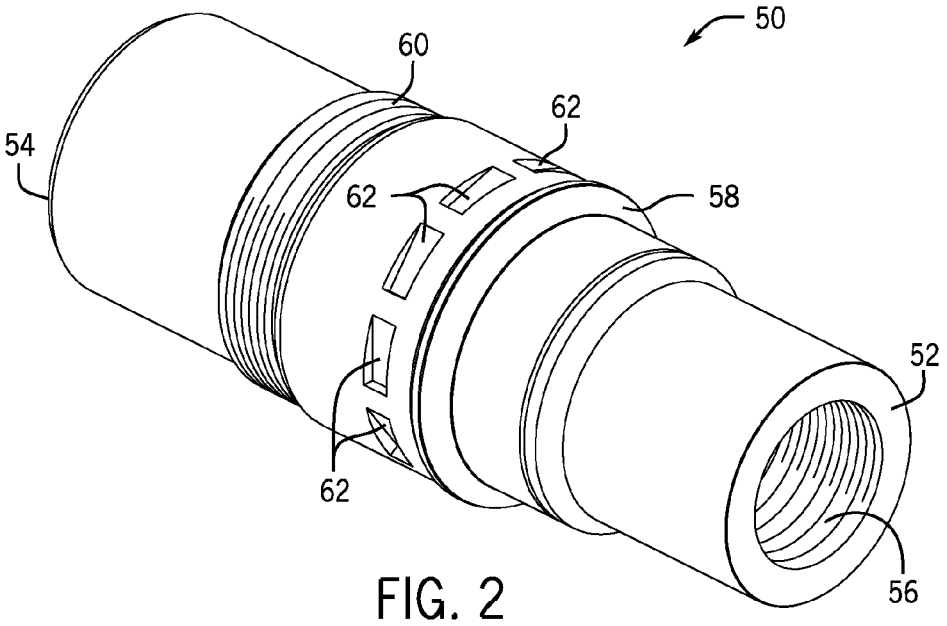
FIG. 2 is a perspective view of a casing hanger having angled recesses formed about its circumference in accordance with one embodiment.
Figure 3:
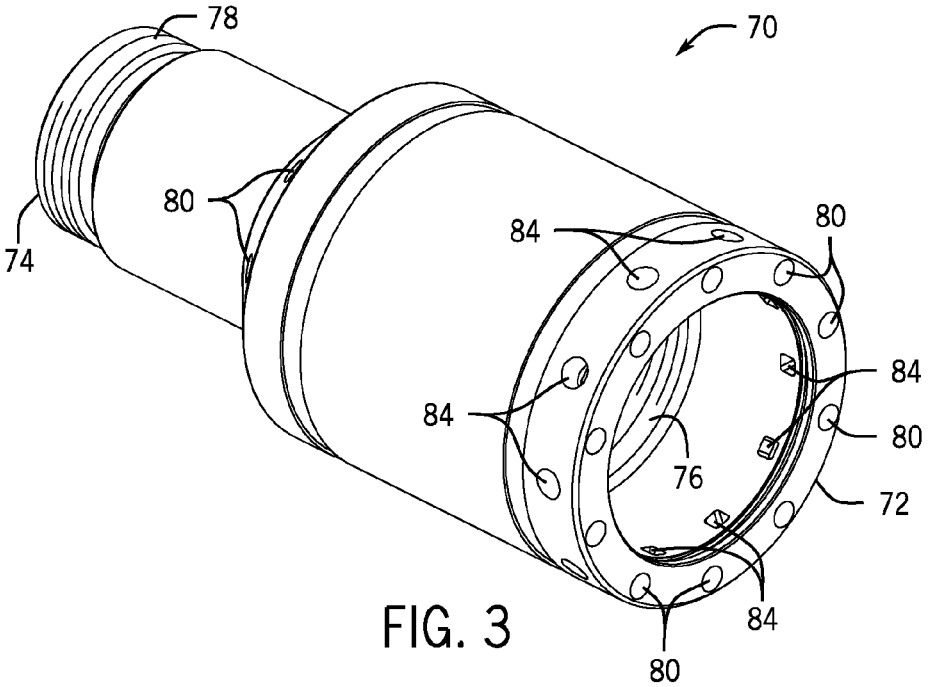
FIG. 3 is a perspective view of a running tool for use with the casing hanger of FIG. 2, the running tool having radial apertures for locking dogs to engage the angled recesses of the casing hanger in accordance with one embodiment.

One embodiment of a casing hanger assembly is generally depicted in FIGS. 2-8. Specifically, a mandrel casing hanger 50 is depicted in FIG. 2 and a mating running tool 70 is depicted in FIG. 3. The casing hanger 50 includes a lower end 52 with internal threads 56 for connecting the casing hanger 50 to a casing string and an upper end 54 that can be received by the running tool 70. The casing hanger 50 also includes a shoulder 58 for landing the casing hanger 50 within a landing ring 92 (FIG. 4) and an external threaded surface 60 for receiving the running tool 70. Still further, the casing hanger 50 includes recesses 62 that facilitate locking engagement of the running tool 70 with the casing hanger 50, as described in greater detail below. The recesses 62 are presently depicted as being arrayed circumferentially about the casing hanger 50 at the same axial distance along the hanger, though other arrangements could be used instead.

The running tool 70 includes a lower end 72 for receiving the casing hanger 50 and an upper end 74 for connection to a component for transmitting torque to the running tool 70 (which can then be transmitted to the casing hanger 50 and a connected casing string). The running tool 70 can be threaded onto the external threaded surface 60 of the casing hanger 50 via internal threaded surface 76, and threads 78 allow connection of the running tool 70 so that it may be driven by another component. The running tool 70 also includes through holes 80 that allow fluid to flow though the running tool 70 when positioned in a casing head. Additionally, the running tool 70 includes holes 84 (also referred to as ports or apertures) that extend from an outer surface of the running tool to an inner surface. In some embodiments, like that shown in FIG. 3, the holes 84 extend radially through the running tool 70. As described in more detail below, the holes 84 are positioned on the running tool 70 so that they can be aligned with the recesses 62 of the casing hanger 50 as the running tool 70 is threaded onto the casing hanger 50.

Figure 4:
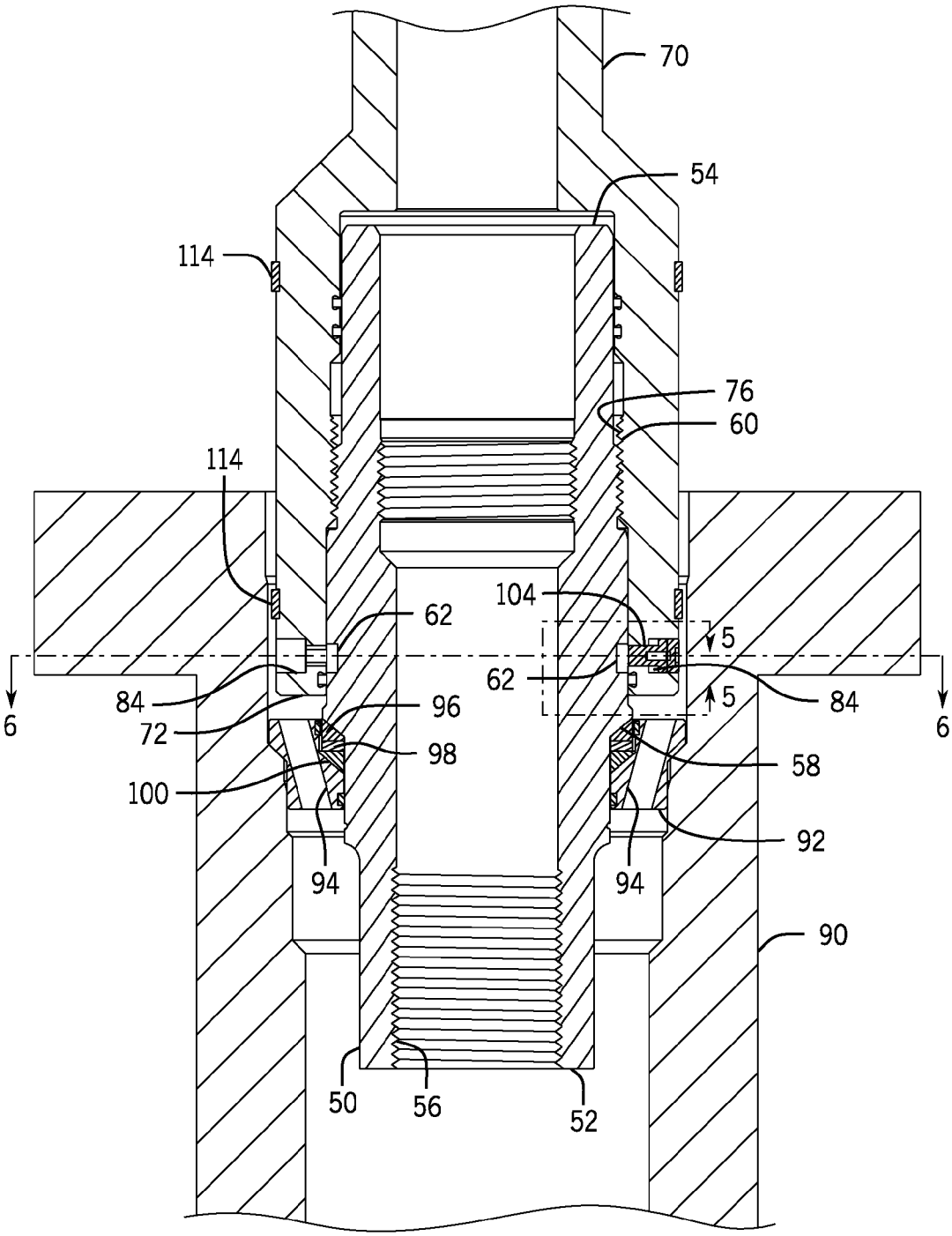
FIG. 4 is cross-section of the casing hanger and the running tool of FIGS. 2 and 3 shown installed within a casing head in accordance with one embodiment.

In FIG. 4, the casing hanger 50 is shown as connected to the running tool 70 and installed within a casing head 90. The casing hanger 50 is received within a landing ring 92 (which may also be referred to as a landing collar) that has an external shoulder that engages an internal shoulder of the casing head 90. The landing ring 92 has flow-by ports 94 that allow the passage of fluid. Additionally, one or more gall-resistant rings can be provided between the landing ring 92 and the casing hanger 50. In the presently depicted embodiment, three gall-resistant rings 96, 98, and 100 are so provided. But other embodiments could have a different number of such rings (including embodiments that omit such rings entirely). The running tool 70 is also depicted in FIG. 4 as including wear bearings 114 about its exterior.

Figure 5:
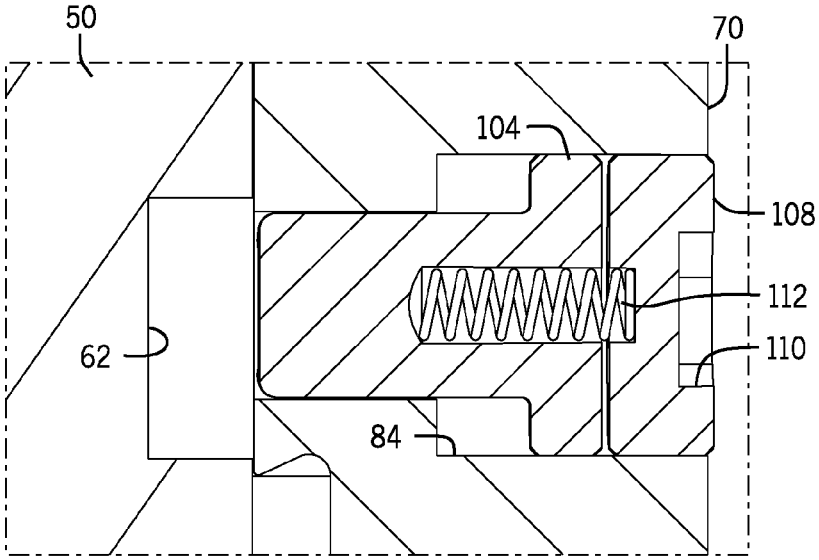
FIG. 5 is a detail view of a locking dog that can be installed within a radial aperture of the running tool and aligned with an angled recess of the casing hanger in accordance with one embodiment.

Locking pins 104 are also provided in some or all of the holes 84 in the running tool 70, and one example of such a locking pin 104 is depicted in FIG. 5. In this example, the locking pin 104 (which may also be referred to as a dog) is enclosed in a hole 84 with a cap 108. The cap 108 can be threaded into the hole 84 or retained in any other suitable manner. The depicted cap 108 includes a tool recess 110 to facilitate installation and removal of the cap 108 from the hole 84. In this embodiment, the locking pin 104 is spring-loaded in that a spring 112 is provided between the cap 108 and the locking pin 104 so as to provide a biasing force (directed radially inward) to the pin 104.

Figure 6:
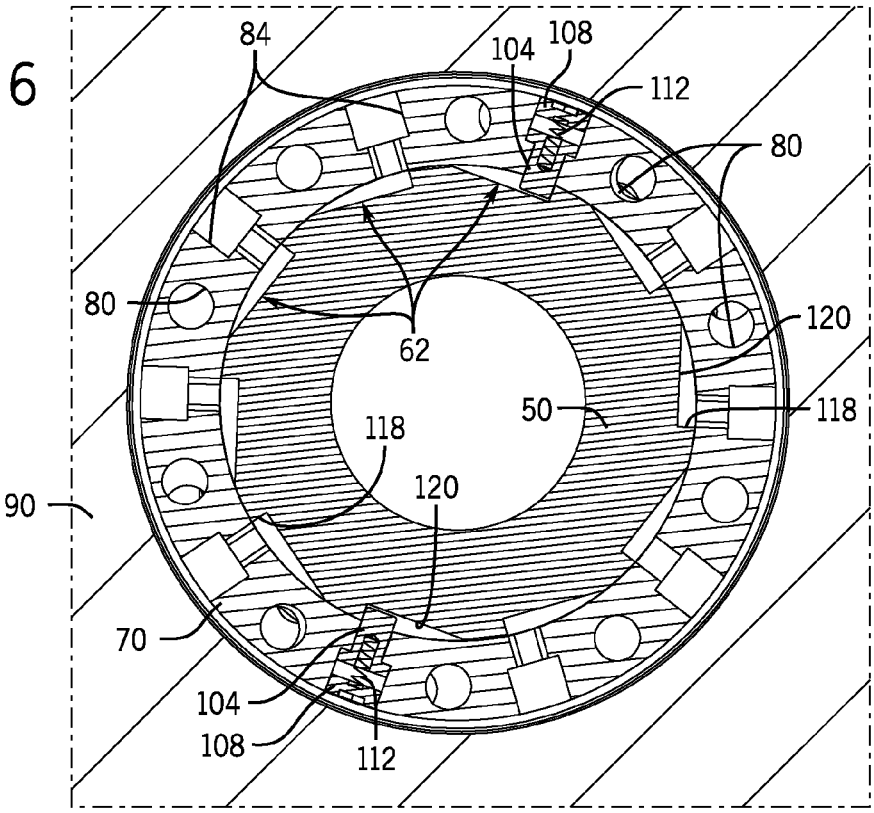
FIG. 6 is an axial cross-section of the casing hanger and the running tool in FIG. 4.

The running tool 70 translates axially along the casing hanger 50 as it is threaded onto the casing hanger 50 via threaded surfaces 60 and 76. The locking pins 104 are biased inwardly by springs 112 into engagement with the outer surface of the casing hanger 50 as the running tool 70 is first rotated along the threaded surface 60 until the axial translation of the running tool 70 brings the holes 84 (with the locking pins 104) into alignment with the recesses 62. Upon such alignment, however, the locking pins 104 extend inwardly into the recesses 62 due to the bias applied by the springs 112, as generally depicted in FIG. 6. While only two pins 104 are depicted in FIG. 6 for the sake of clarity, it will be appreciated that in at least some embodiments a locking pin 104 is provided in each of the holes 84 for engaging a mating recess 62. But in other embodiments, fewer than all of the holes 84 include a locking pin 104. And while the depicted embodiment includes ten recesses 62 and ten holes 84, other embodiments can differ from such a configuration.

Each recess 62 in FIG. 6 is shown as having an angled profile with a stop surface or shoulder 118 and an angled (return) surface 120. In at least some embodiments, such as that depicted here, the stop surfaces are radial stop surfaces that are formed orthogonal to the outer circumference of the casing hanger 50. In the present embodiment, the running tool 70 is rotated clockwise (via right-handed threads on surfaces 60 and 76) down onto the casing hanger 50 until the locking pins 104 are aligned with the recesses 62.

When aligned in this manner, the locking pins 104 are pushed into the recesses 62 by the springs 112 and engagement of the pins 104 with the stop surfaces 118 inhibits further rotation of the running tool 70 about the casing hanger 50 in the clockwise direction. Rather, once the locking pins 104 extend into the recesses 62, further rotation of the running tool 70 in the clockwise direction causes synchronous movement of the casing hanger 50 in the clockwise direction. That is, the locking pins 104 transmit torque on the running tool 70 to the casing hanger 50 via the stop surfaces 118. Through this engagement, the running tool 70 can rotate the casing hanger 50 and an attached casing string, such as during cementing of the casing string. Using the locking pins 104 in this way prevents the running tool 70 from being excessively tightened onto the casing hanger 50 via the threaded surfaces 60 and 76, and allows rotation of the casing hanger 50 by the running tool 70 without transmitting torque directly through the threads of surfaces 60 and 76 (which could cause the threads to stick and prevent removal of the running tool 70 from the casing hanger 50). It also permits easy removal of the running tool 70 from the casing hanger 50, such as after cementing the casing. Particularly, the running tool 70 can be threaded off the casing hanger 50 (e.g., by rotating it counterclockwise in the present embodiment) with little or no break-out torque required. The angled surfaces 120 push the locking pins 104 against the springs 112 and back into the holes 84, allowing the running tool 70 to rotate freely off of the casing hanger 50.

Figure 7:
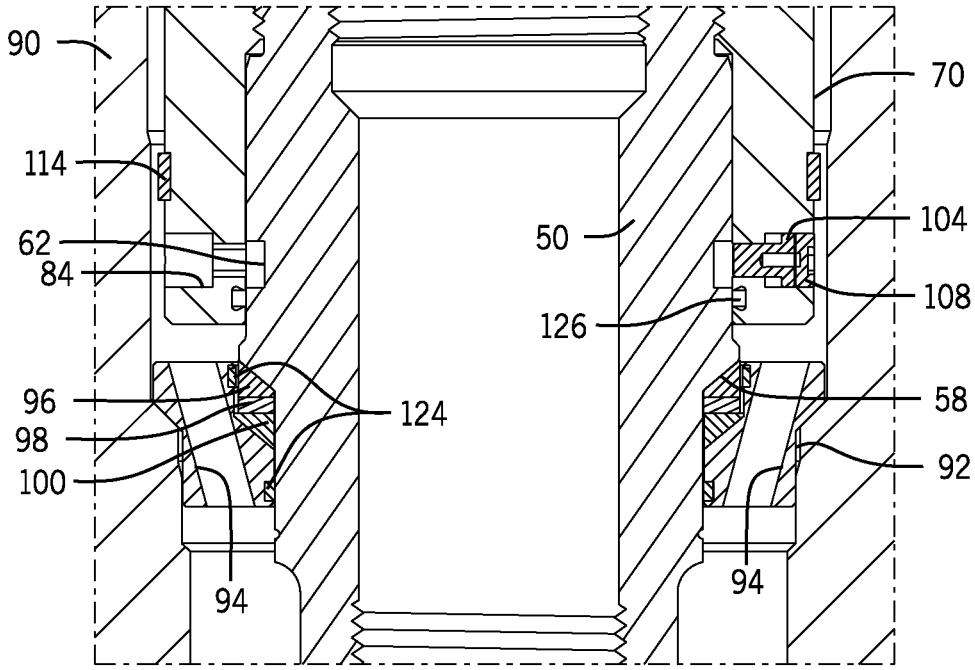
FIG. 7 is a detail view of a landing ring depicted in FIG. 4, the landing ring having several gall-resistant rings to facilitate rotation of the casing hanger with respect to the landing ring in accordance with one embodiment.
Figure 8:
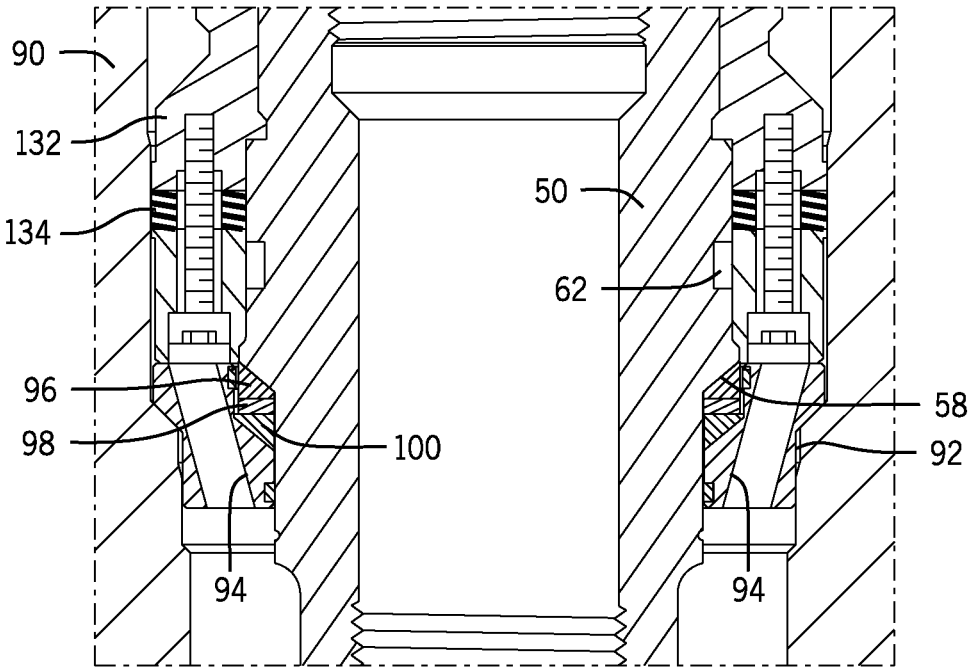
FIG. 8 is a detail view generally depicting a packoff installed in the casing head after removal of the running tool from the casing hanger in accordance with one embodiment.

Additional details of the rotation of the casing hanger 50 with respect to the landing ring 92 may be better appreciated with reference to FIG. 7. In this illustration, the landing ring includes strips 124 that reduce friction between rotating components (here the casing hanger 50, the landing ring 92, and the gall-resistant ring 96) and a wiper seal 126 to inhibit entry of fluid (e.g., cement) into the recesses 62 or holes 84. As noted above, the present embodiment includes three gall-resistant rings 96, 98, and 100. Such gall-resistant rings can be made from any suitable material, such as nitrided chromoly steel. As depicted, the ring 96 has a tapered upper edge that engages the shoulder 58 of the casing hanger 50, and the ring 100 includes a tapered lower edge that engages a mating shoulder of the landing ring 92. The ring 98 in the present embodiment is provided with two parallel surfaces for engaging mating surfaces of the rings 96 and 100. Again, the inclusion of one or more gall-resistant rings reduces wear on the casing hanger 50 and the landing ring 92, while allowing the landing ring 92 to support some or all of the load from the casing hanger (and attached casing) during rotation of the casing while cementing. Of course, the casing hanger 50 could instead be lifted off of the landing ring 92 such that the full load of the casing hanger 50 and the casing is supported in some other way (e.g., by a top drive). Once the casing is cemented into place, the running tool 70 can be removed from the casing hanger 50 and a packoff 132 with a rubber sealing component 134 can be installed in the casing head 90, as generally depicted in FIG. 8.

Figure 9:
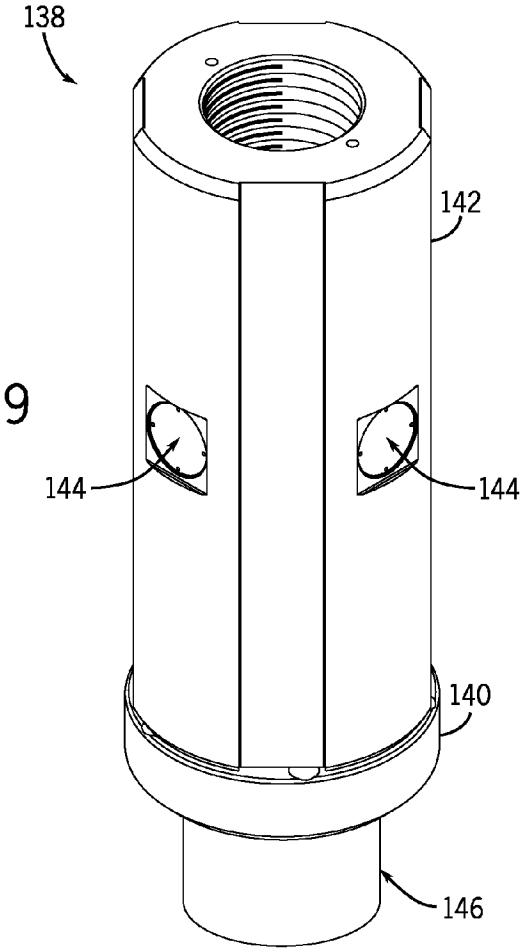
FIG. 9 is a perspective view of a wellhead hanger assembly with a running tool having locking dog assemblies coupled to a casing hanger in accordance with one embodiment.

Another embodiment of a wellhead hanger assembly is generally depicted in FIGS. 9-17. As shown in FIG. 9, a wellhead hanger assembly 138 includes a wellhead hanger, in the form of casing hanger 140, coupled to a running tool 142. Locking dog assemblies 144 installed in the running tool 142 engage the casing hanger 140 to facilitate rotation of the casing hanger 140 by the running tool 142.

Figure 10:
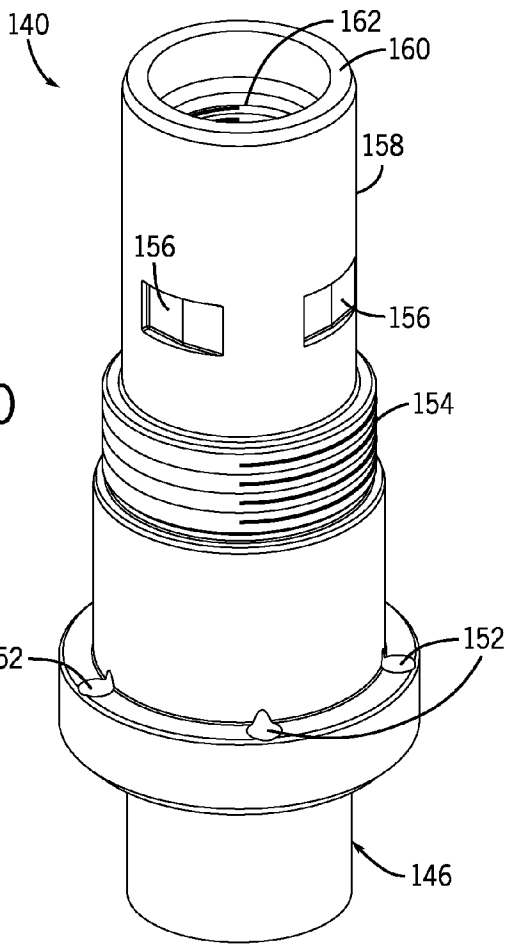
FIGS. 10 and 11 are perspective and sectional views of the casing hanger of FIG. 9 in accordance with one embodiment.
Figure 11:
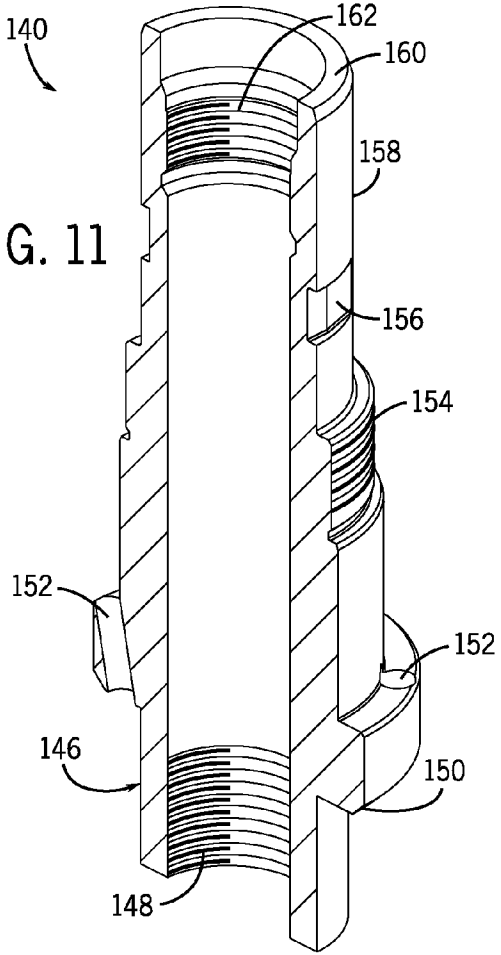

Additional details of the casing hanger 140 are generally depicted in FIGS. 10 and 11 in accordance with one embodiment. As shown in these two figures, the casing hanger 140 includes a lower end 146 with an internal threaded surface 148 for mating with a casing string. The lower end 146 also includes a flange with a chamfered edge, forming a shoulder 150, and flow-by ports 152. In other embodiments, the flange could include flutes in addition to, or instead of, the flow-by ports 152. The casing hanger 140 is shown here as having a lower neck portion or box connection extending downwardly from the flange for receiving a casing string at its lower end 146. But in other embodiments, the body of the casing hanger 140 could be provided in a different form. For example, the lower neck portion could be omitted and the lower end 146 of the casing hanger 140 could terminate with the flange having the shoulder 150 and the flow-by ports 152. In this instance, the internal threaded surface 148 could be axially aligned with the flange at the bottom of the casing hanger 140.

The casing hanger 140 also includes a threaded surface 154, which allows the running tool 142 to be threaded onto the casing hanger 140, and recesses 156 formed in its exterior surface. As described in additional detail below, the recesses 156 receive dogs of locking dog assemblies to facilitate synchronous rotation of the casing hanger 140 with the running tool 142. The casing hanger 140 further includes an upper end 160 with a seal neck 158 and an internal threaded surface 162, which allows other components (e.g., a back pressure valve or a two-way check valve) to be threaded to the casing hanger 140.

Figure 12:
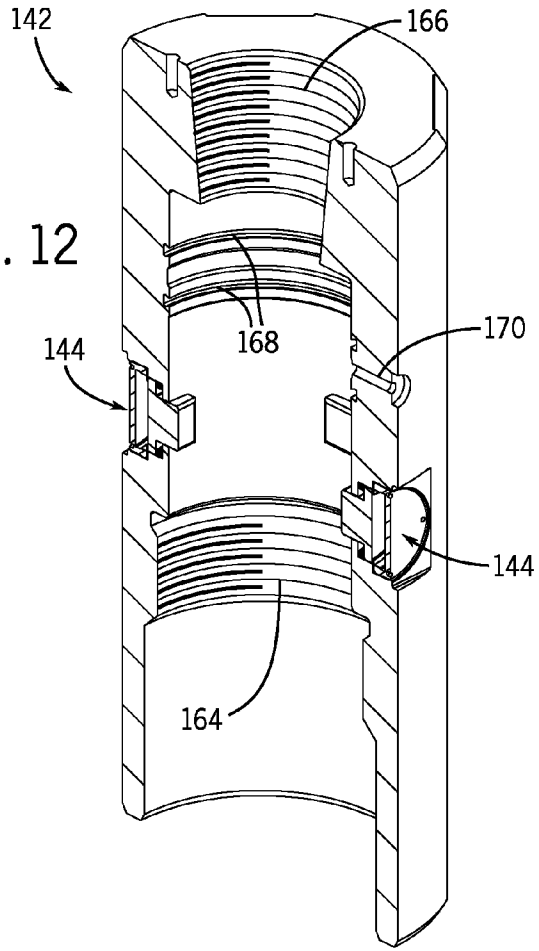
FIG. 12 is a sectional view of the running tool of FIG. 9 in accordance with one embodiment.

Certain aspects of the running tool 142, according to one embodiment, are illustrated in FIG. 12. For instance, the depicted running tool 142 includes a threaded surface 164 for mating with the threaded surface 154 of the casing hanger 140. In this embodiment, the threaded surface 164 is provided below the locking dog assemblies 144, though other arrangements are possible (see, e.g., FIG. 4 with locking dogs 104 below threaded surface 76). The locking dog assemblies 144 are provided in an upper end of a running tool (i.e., closer to the top of the running tool 142 than to the bottom of the tool 142) in some embodiments. And in some cases, the threaded surface 164 could be provided in the upper end of the running tool 142 (e.g., along with the locking dog assemblies 144), with the mating threaded surface 154 of the hanger 140 accordingly repositioned further from the flange. In one such embodiment, the bottom of the running tool 142 could be lengthened (compared to that shown in FIG. 12) so that the threaded surface 164 is closer to the top of the running tool than to the bottom. The depicted running tool 142 also includes a threaded surface 166 (e.g., for receiving a landing joint), seal grooves 168 for receiving seals, and a test port 170 for testing proper sealing between the running tool 142 and the casing hanger 140 by seals in the seal grooves 168.

Figure 13:
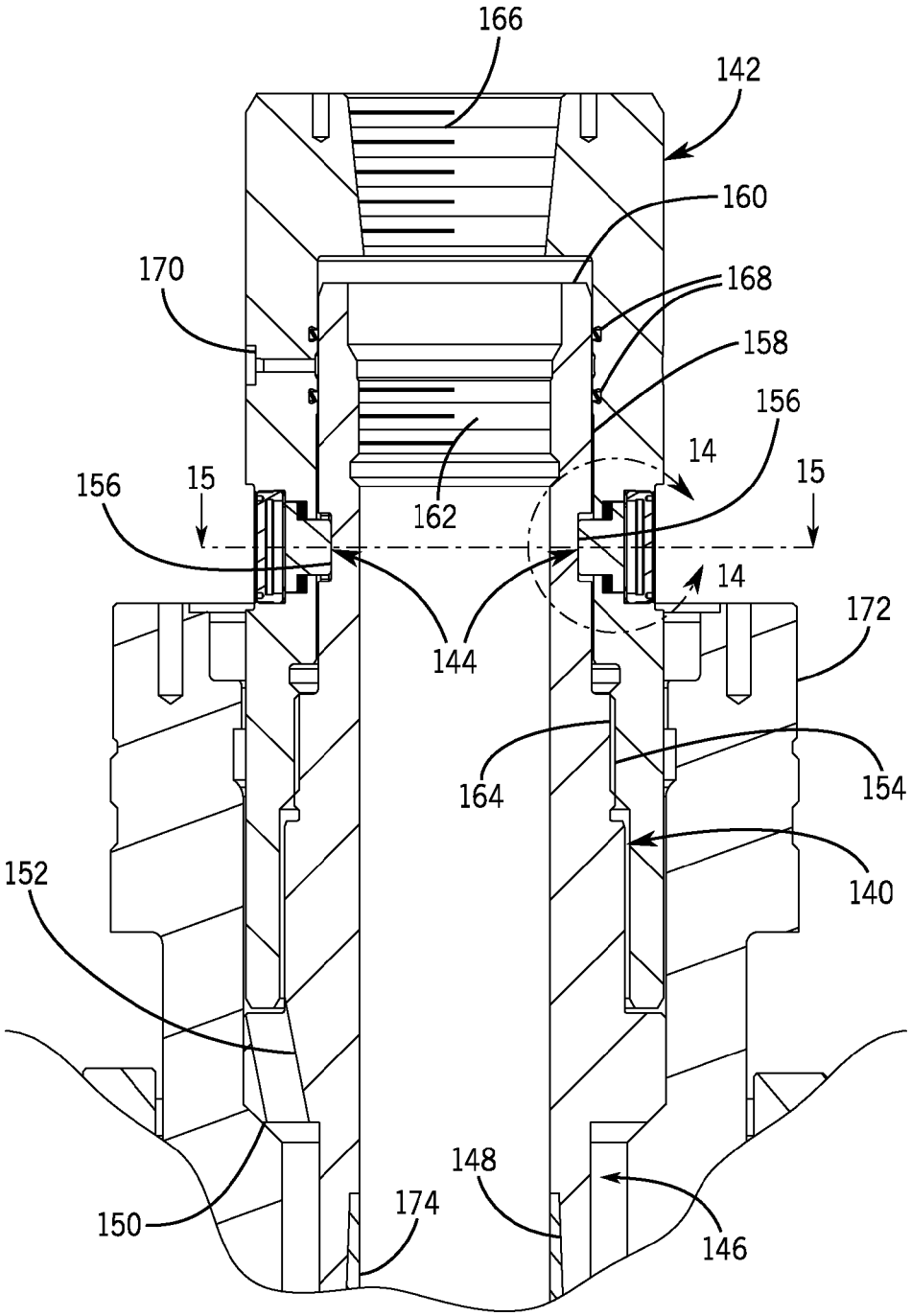
FIG. 13 is a cross-section of the wellhead hanger assembly of FIG. 9 installed in a casing head in accordance with one embodiment.

A casing string 174 can be coupled to the casing hanger 140 (e.g., via threaded surface 148) and the running tool 142 can be used to run the casing hanger 140 into a casing head 172, as generally depicted in FIG. 13. Although omitted in FIG. 13 for the sake of clarity, it will be appreciated that the casing hanger 140 can be run into the casing head 172 through other components (e.g., a blowout preventer) attached to the wellhead stack above the casing head 172. In at least some embodiments, the locking dog assemblies 144 are installed in the running tool 142 after the running tool is threaded onto the casing hanger 140. For example, to assemble the casing hanger 140 and the running tool 142 in one embodiment, a landing joint is threaded into the running tool 142 to engage threaded surface 166. The running tool 142 can then be lifted via the landing joint, positioned over the casing hanger 140, and then rotated (e.g., clockwise) as it is lowered onto the casing hanger 140 to thread the running tool 142 and the casing hanger 140 together via threaded surfaces 154 and 164. The running tool 142 can continue to be rotated about the casing hanger 140 until radial ports in the running tool 142 for receiving the locking dog assemblies 144 are axially and radially aligned with the recesses 156 in the exterior surface of the casing hanger 140.

Figure 14:
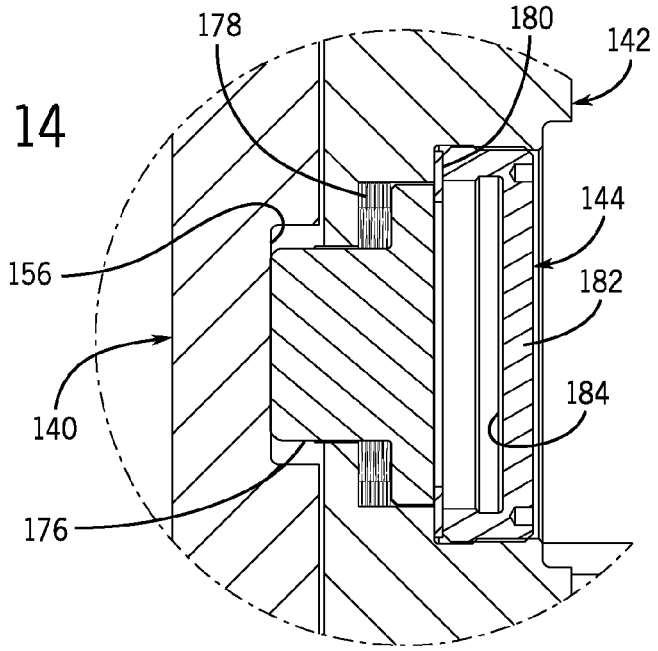
FIG. 14 is a detail view of a locking dog assembly installed in a port of the running tool as depicted in FIG. 13.

Once the radial ports are aligned with the recesses 156, the locking dog assemblies 144 can be installed in the radial ports of the running tool 142. One example of a locking dog assembly 144 is shown in FIG. 14 as including a dog 176, a biasing component (e.g., spring 178), a shear component 180, and a retaining cap 182. Any suitable biasing component could be used in the locking dog assembly 144. When provided as a spring, the biasing component could include a compression spring, a disc spring, or a tapered spring, to name only a few examples. The spring 178 can be inserted into a radial port in the running tool, followed by the dog 176. The inserted dog 176 can be pushed inwardly to extend through the radial port and into the recess 156 in the casing hanger 140. The shear component 180 is installed behind (i.e., radially outward from) the dog 176, and a retaining cap 182 is inserted into the radial port behind the shear component 180. The shear component 180 is provided here as a shear washer, but could be provided in other forms (e.g., one or more shear pins). The retaining cap 182 includes a recess 184 for receiving the dog 176, as described in greater detail below. The cap 182, which can be threaded into the radial port or retained in any other suitable manner, also includes tool recesses that facilitate installation and removal.

As shown here, the radial port includes a first counterbore for receiving the spring 178 and the dog 176 and a second, larger counterbore for receiving the shear component 180 and the retaining cap 182. But the radial port could be configured differently in other embodiments. Indeed, although presently described as radial ports, the ports through the running tool 142 into which the locking dog assemblies are installed could be formed at an angle with respect to a line normal to the inner and outer surfaces of the wall of the running tool 142 at which the port is formed. In such cases, it will be appreciated that dogs installed in the ports may still move inwardly and outwardly (i.e., closer to and further from the center, rotational axis of the casing hanger 140 and the running tool 142) to engage and disengage the casing hanger 140 and be used to transmit torque as described herein, even if the path of movement of the dogs is not actually radial with respect to the center axis.

Figure 15:
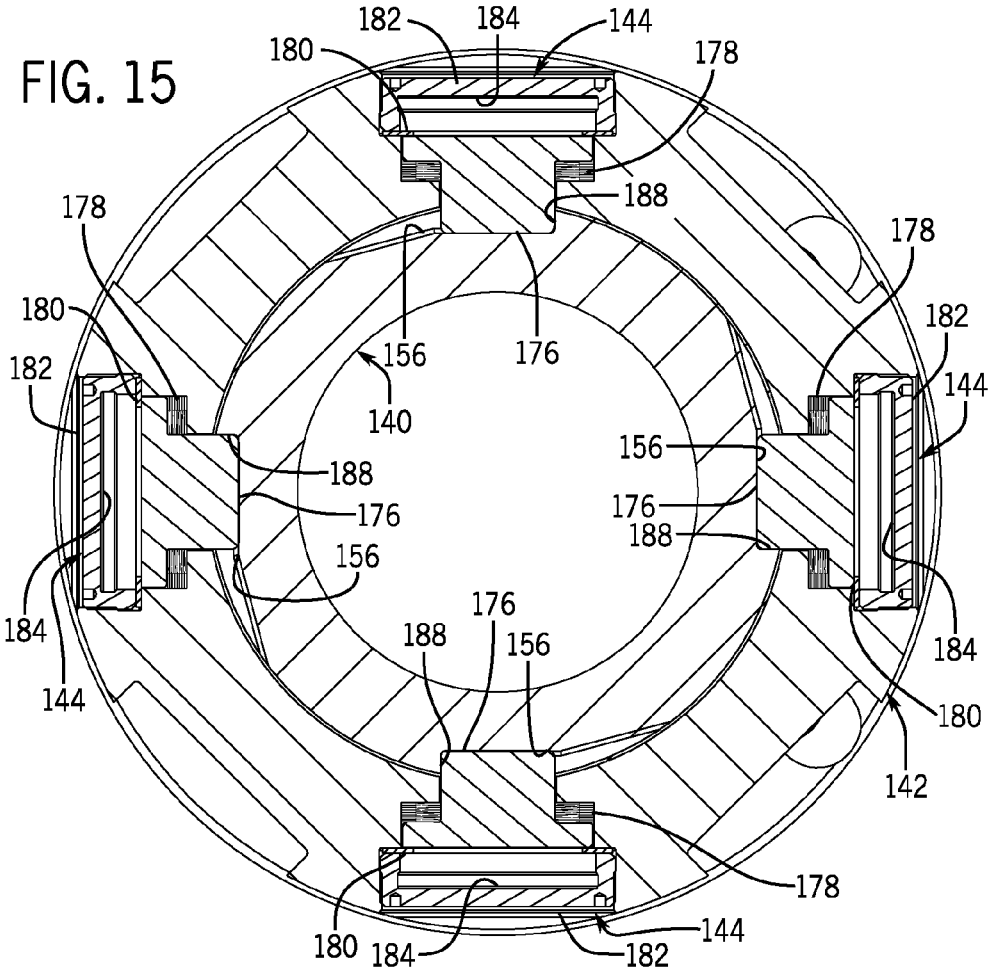
FIG. 15 is an axial cross-section of the wellhead hanger assembly of FIG. 9 and shows dogs of the locking dog assembly inserted into recesses in the casing hanger.

With the locking dog assembly 144 installed in the radial port depicted in FIG. 14, the compressed spring 178 biases the dog 176 radially outward. The shear component 180 and the retaining cap 182 resist the biasing of the spring 178 and hold the dog 176 in its locked (i.e., engaged) position, in which the dog 176 extends radially inward from the running tool 142 into the recess 156 of the casing hanger 140. An axial cross-section of the hanger assembly 138 is generally depicted in FIG. 15 with the locking assemblies 144 installed in the radial ports of the running tool 142 and the dogs 176 engaging the recesses 156 of the casing hanger 140. The running tool 142 can be rotated in one direction (clockwise in FIG. 15) so that the dogs 176 bear against stop surfaces or shoulders 188 of the recesses 156, preventing relative rotation of the running tool 142 with respect to the casing hanger 140 and causing the dogs 176 to transmit torque from the running tool 142 to the casing hanger 140. This allows the dogs 176 to drive synchronous rotation of the casing hanger 140 with the running tool 142. The hanger assembly 138 can then be lifted (e.g., via the landing joint) and threaded to the casing string 174. In some instances, this may include attaching a casing pup joint to the casing hanger 140 (before or after connecting the running tool 142 to the casing hanger 140), aligning the hanger assembly 138 and the attached pup joint over a casing string in the well, and rotating the hanger assembly 138 to thread the pup joint to the casing string. The casing hanger 140 can then be lowered into the wellhead (e.g., into the casing head 172). In some instances, the casing hanger 140 and its attached casing string 174 can be rotated while running the casing hanger 140 into the wellhead. In one embodiment, the casing hanger 140 and the attached casing string 174 are rotated while running the casing string 174 into a deviated well. Rotation of the casing hanger 140 can also facilitate cementing of the attached casing string 174 within the well.

Figure 16:
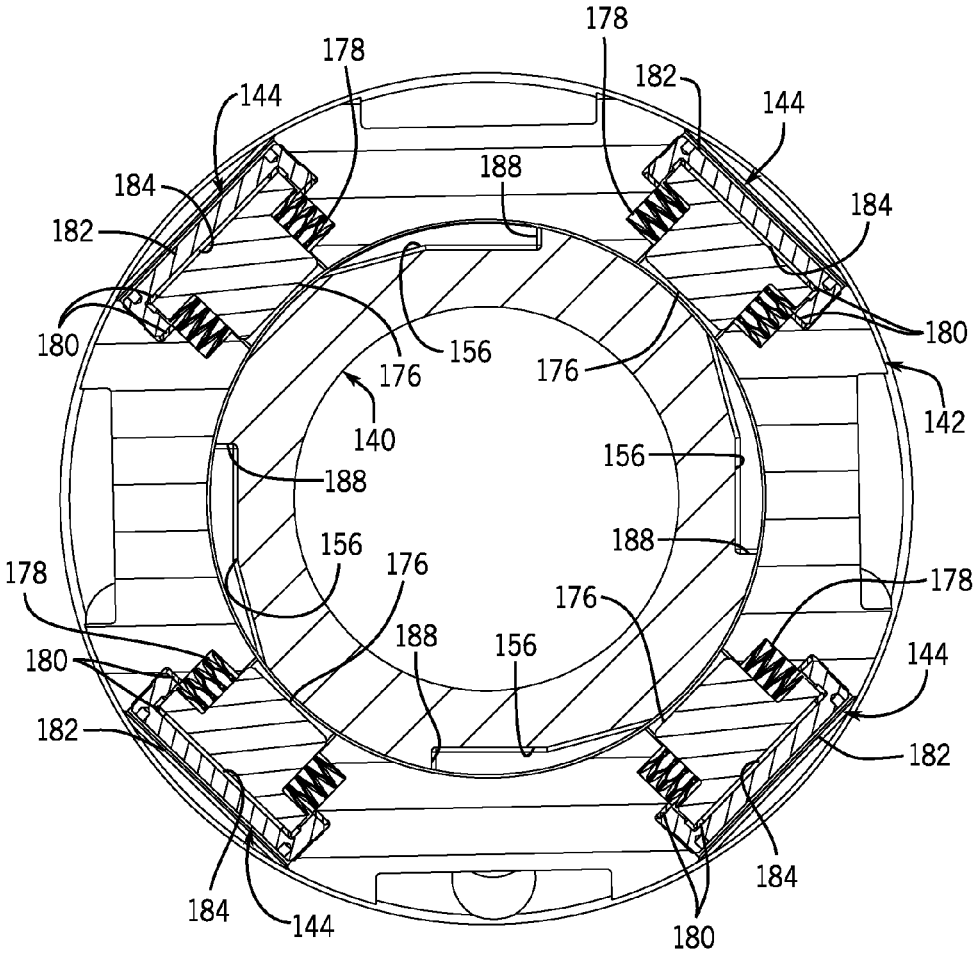
FIG. 16 is an axial cross-section of the wellhead hanger assembly after the running tool has been rotated to break shear components behind the dogs and cause the dogs to retract away from the casing hanger.

After desired rotation of the casing hanger 140 is completed and the hanger 140 is landed, the running tool 142 can be rotated in the opposite direction (e.g., counter-clockwise) to disconnect the running tool 142 from the hanger 140. When the running tool 142 is rotated in this opposite direction with sufficient break-out torque (enough to break shear components 180), the return surfaces of the recesses 156 drive the dogs 176 radially outward and cause the shear components 180 to shear. The biasing springs 178 then cause the dogs 176 to automatically retract from the recesses 156 to their disengaged positions, out of contact with the casing hanger 140 and into the recesses 184 in the retaining caps 182, as generally shown in FIG. 16. The running tool 142 can be further rotated to unthread the running tool 142 from the casing hanger 140. Because the dogs 176 are automatically retracted out of engagement with the casing hanger 140, the dogs 176 will not scratch or otherwise mar the seal neck 158 of the casing hanger 140 as the running tool 142 is unthreaded from the casing hanger 140. Consequently, the present arrangement reduces the risk of damage to sealing surfaces along the casing hanger 140 above the recesses 156. Once disconnected from the casing hanger 140, the running tool 142 can be pulled from the wellhead. Other components, such as a packoff, can then be installed above the casing hanger 140 in the wellhead.

Figure 17:
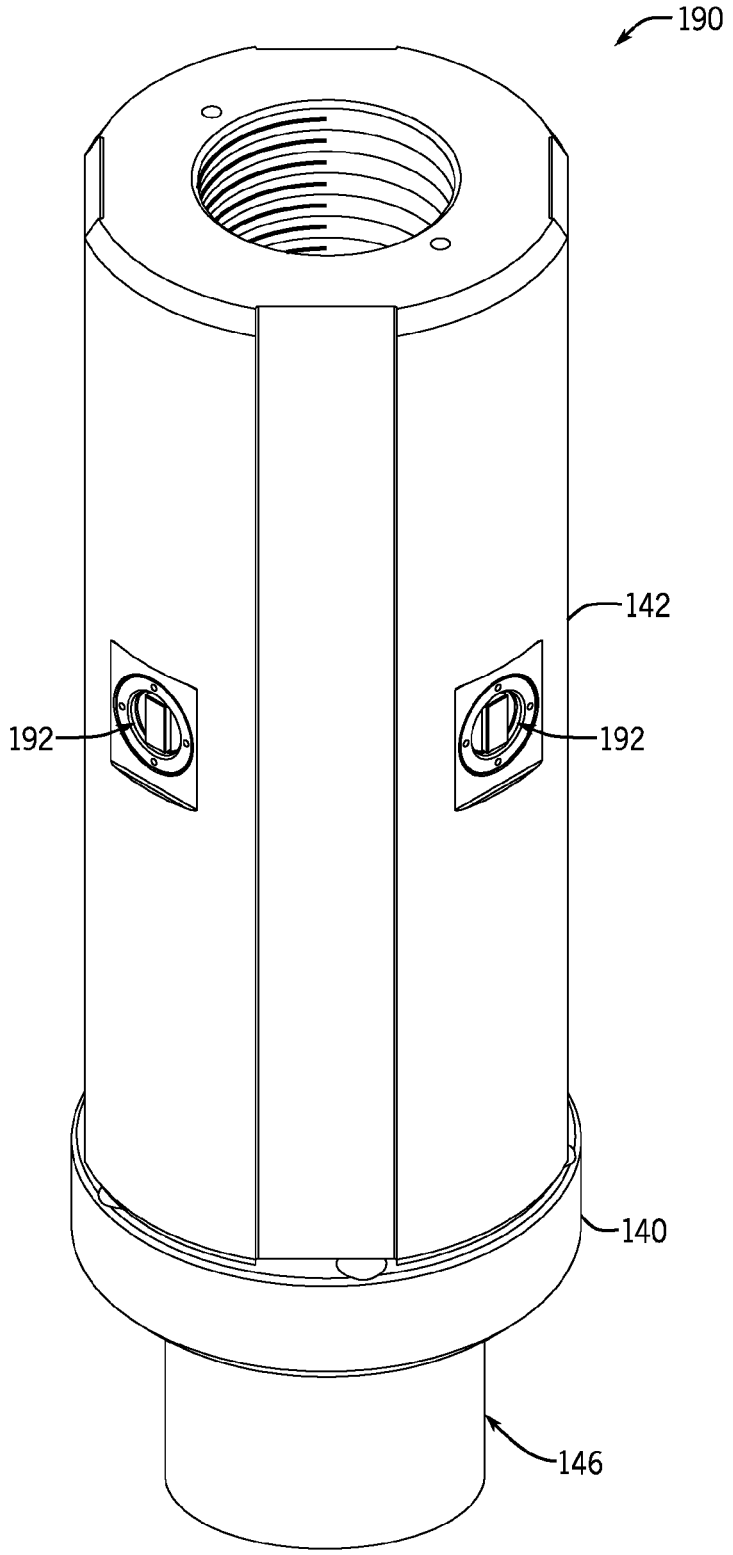
FIG. 17 is a perspective view of another wellhead hanger assembly with a running tool having locking dog assemblies coupled to a casing hanger in accordance with one embodiment.
Figure 18:
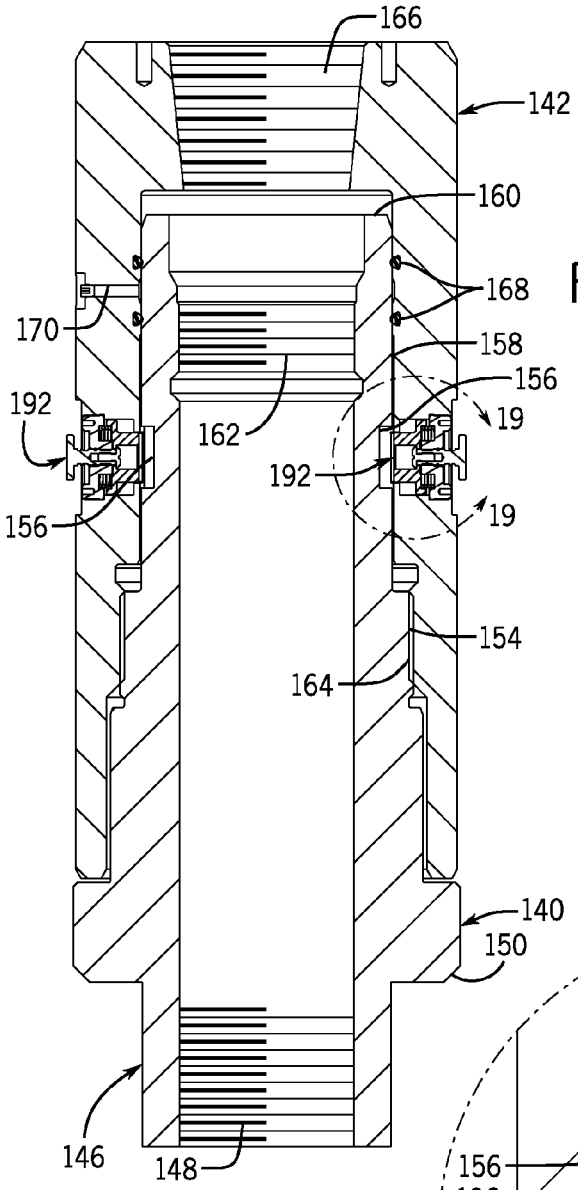
FIG. 18 is a cross-section of the wellhead hanger assembly of FIG. 17 showing dogs of the locking dog assemblies held in a disengaged position away from the casing hanger in accordance with one embodiment.
Figure 19:
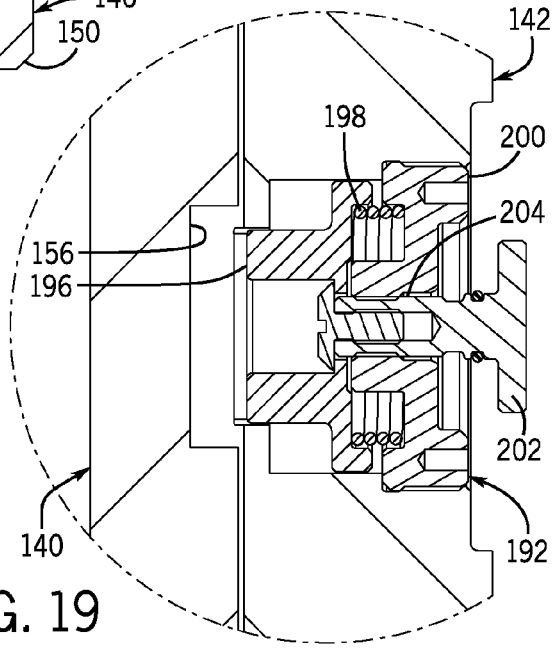
FIG. 19 is a detail view of a locking dog assembly as shown in FIG. 18.
Figure 20:
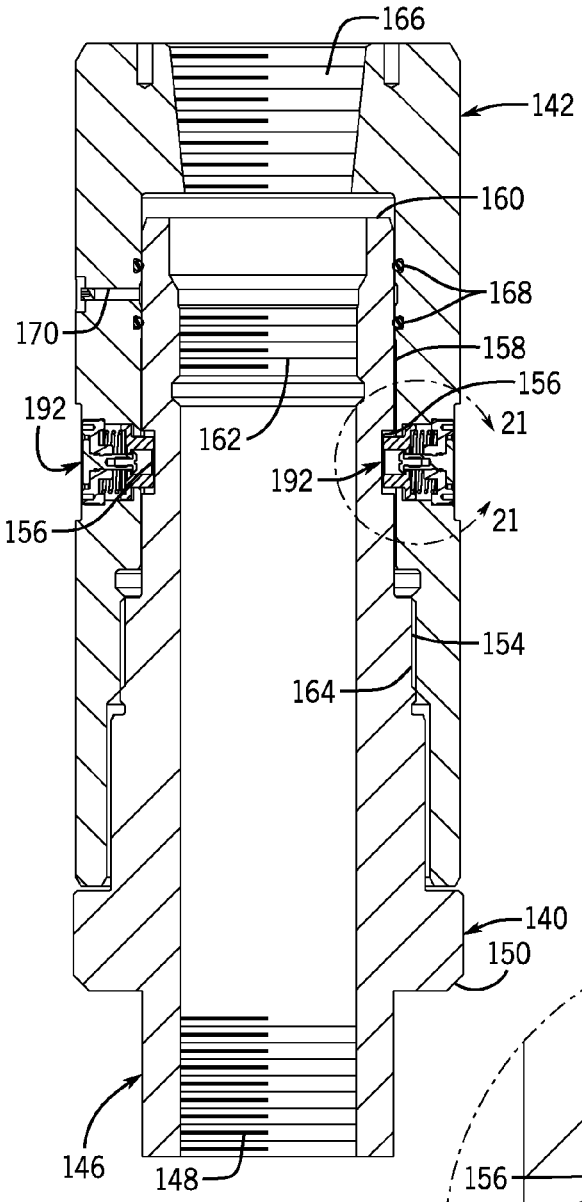
FIG. 20 is a cross-section of the wellhead hanger assembly of FIG. 17 showing the dogs of the locking dog assembly moved into engagement with the casing hanger by rotating handles coupled to the dogs in accordance with one embodiment.
Figure 21:
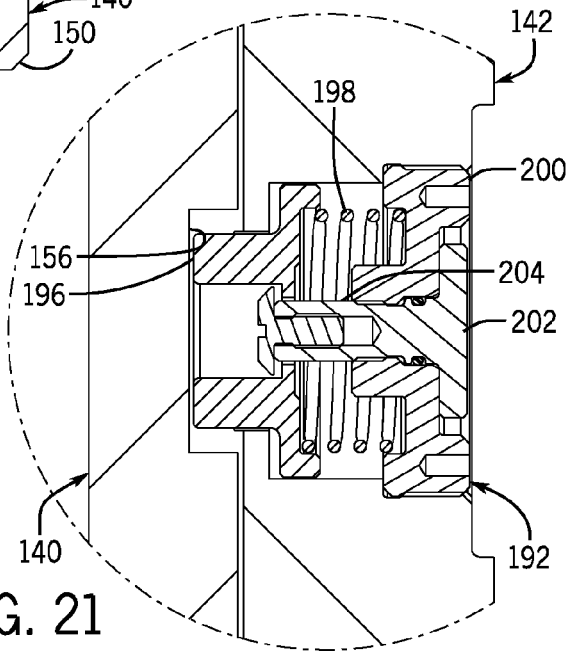
FIG. 21 is a detail view of a locking dog assembly as shown in FIG. 20.

Another wellhead hanger assembly is generally depicted in FIGS. 17-21. As shown in FIGS. 17 and 18, a wellhead hanger assembly 190 includes the casing hanger 140 and the running tool 142 coupled together, with locking dog assemblies 192 installed in radial ports of the running tool 142 so as to engage the casing hanger 140. Like the locking dog assemblies 144, the locking dog assemblies 192 can transmit torque between the running tool 142 and the casing hanger 140 and facilitate rotation of the casing hanger 140 and any attached casing string 174, such as during run-in or cementing processes. The locking dog assemblies 192 can also be provided in the upper end of the running tool 142, as described above for locking dog assemblies 144. FIGS. 17, 20, and 21 generally depict the locking dog assemblies 192 in their locked positions (in which the dogs engage recesses 156 of the casing hanger 140), while FIGS. 18 and 19 depict the locking dog assemblies in their unlocked positions (with dogs retracted from the recesses 156).

An example of a locking dog assembly 192 is depicted in FIG. 19 as including a dog 196, a biasing component (e.g., spring 198), a retaining cap 200 threaded into the radial port, and a handle 202. The handle 202 includes a stem 204 threaded through the retaining cap 200 and coupled to the dog 196. The locking dog assemblies 192 can be installed in radial ports of the running tool 142 before or after threading the running tool 142 onto the casing hanger 140.

The handle 202 can be rotated to radially move the dog 196 into or out of engagement with the casing hanger 140. The spring 198 is compressed between the dog 196 and the retaining cap 200 and biases the dog 196 radially inward. The handle 202 is accessible at the outer surface of the running tool 142 and is shown in FIG. 19 as holding the dog 196 in a retracted position away from the casing hanger 140. In one assembly technique, the dogs 196 are kept in this retracted position as the running tool 142 is threaded onto the casing hanger 140. The handles 202 are then turned to the engaged positions depicted in FIGS. 20 and 21, allowing the biasing springs 198 to push the dogs 196 into engagement with the casing hanger 140. If the radial ports of the running tool 142 are aligned with the recesses 156 when the handles 202 are turned to their engaged position, the springs 198 will push the dogs 196 radially inward into the recesses 156. If the radial ports of the running tool 142 are offset from the recesses 156 when the handles 202 are turned to their engaged position, the springs 198 will push the dogs 196 radially inward into contact with the exterior surface of the casing hanger 140. The running tool 142 can then be rotated about the casing hanger 140 to align the dogs 196 with the recesses 156, at which time the biasing springs 198 will push the dogs 196 into the recesses 156.

Once the dogs 196 extend into the recesses 156, the running tool 142 can be rotated to drive synchronous rotation of the casing hanger 140 (via engagement of the dogs 196 with the stop surfaces 188 of the recesses 156) as described above with respect to hanger assembly 138. To disconnect the running tool 142 from the casing hanger 140 (e.g., after running the casing hanger 140 into the casing head 172, cementing an attached casing string 174, and landing the casing hanger 140), the running tool 142 can be rotated to unthread the running tool 142 from the casing hanger 140. The return surfaces of the recesses 156 push the dogs 196 radially outward against the biasing of the springs 198 when the running tool 142 is unthreaded from the casing hanger 140, allowing the dogs 196 to exit the recesses 156 and the running tool 142 to be freely removed. With no shear components 180 to break, little or no break-out torque is needed to unthread the running tool 142 from the casing hanger 140.

Each of the hanger assemblies described above can be used to rotate a casing string during running of the casing hanger into a well or cementing of the casing string within the well. In at least some embodiments, the load due to the weight of the casing hanger and its attached casing string can be carried entirely by the mating threads of the casing hanger and the running tool (e.g., surfaces 60 and 76; surfaces 154 and 164), while the applied torque used to rotate the hanger is carried entirely by the dogs of the running tool. Further, while certain embodiments may be described in the context of casing hangers, it is noted that the presently disclosed techniques could also be used to rotate other kinds of hangers, such as those connected to other tubular strings or to rods. The running tools described herein can be used to transmit torque to the hangers (whether casing hangers or some other types of hangers), causing the hangers to rotate synchronously with the running tools. Once rotation is completed and the hangers are landed, the running tools can be removed from the hangers.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a casing hanger;

a casing hanger running tool coupled to the casing hanger, wherein an exterior surface of the casing hanger includes a recess, the casing hanger running tool includes a dog that extends inward from the casing hanger running tool into the recess of the exterior surface of the casing hanger, and the recess of the exterior surface of the casing hanger includes a stop surface configured to bear against the dog to prevent relative rotation of the casing hanger running tool with respect to the running tool when the casing hanger running tool is rotated in a first direction;

a biasing component positioned to bias the dog outward away from the casing hanger; and a shear component that opposes the outward biasing of the dog by the biasing component and inhibits movement of the dog out of the recess of the exterior surface of the casing hanger.

2. The apparatus of claim 1, wherein the recess of the exterior surface of the casing hanger includes a return surface configured to bias the dog out of the external recess by causing the shear component to shear when the running tool is rotated in a second direction opposite the first direction.

3. The apparatus of claim 1, wherein the shear component is a shear washer installed between the dog and a retaining cap.

4. The apparatus of claim 1, wherein the exterior surface of the casing hanger includes a plurality of recesses and the casing hanger running tool includes a plurality of radially movable dogs that extend radially inward from the casing hanger running tool into the plurality of recesses of the exterior surface of the casing hanger.

5. The apparatus of claim 1, wherein the casing hanger and the casing hanger running tool are coupled together by mating threads.

6. The apparatus of claim 1, wherein the casing hanger is disposed within a casing head.

7. A method comprising:

threading a running tool to a wellhead hanger;

engaging an external recess of the wellhead hanger with a dog installed in a radial port through the running tool, wherein engaging the external recess of the wellhead hanger with the dog includes aligning the radial port through the running tool with the external recess of the wellhead hanger and inserting the dog into the external recess through the radial port;

inserting a shear component in the radial port radially outward from the dog;

coupling the wellhead hanger to a tubular string that is in a well; and rotating the tubular string by rotating the running tool in a first direction and transmitting torque from the running tool to the wellhead hanger through the engagement of the dog with the external recess of the wellhead hanger.

8. The method of claim 7, comprising rotating the running tool in a second direction, opposite the first direction, to cause the shear component to shear and the dog to retract out of contact with the wellhead hanger.

9. The method of claim 7, comprising lowering the wellhead hanger into a wellhead while rotating the tubular string.

10. The method of claim 7, comprising rotating the tubular string while cementing the tubular string within the well.

11. The method of claim 7, wherein the well is a deviated well, the method further comprising rotating the tubular string while running the tubular string into the deviated well.

* * * * *